United States Patent [19]

Reider

[11] 4,312,186

[45] Jan. 26, 1982

[54] SHINGLED LAMINATED POROUS MATERIAL

[75] Inventor: Samuel B. Reider, Indianapolis, Ind.

[73] Assignee: General Motors Corporation, Detroit, Mich.

[21] Appl. No.: 85,603

[22] Filed: Oct. 17, 1979

[51] Int. Cl.[3] ..... F02C 3/14; F23R 3/42

[52] U.S. Cl. ..... 60/754

[58] Field of Search ..... 60/754; 416/231 R

[56] References Cited

U.S. PATENT DOCUMENTS

| | | | |
|---|---|---|---|
| 3,064,424 | 11/1962 | Tomlinson . | |
| 3,064,425 | 11/1962 | Hayes . | |
| 3,075,352 | 1/1963 | Shutts . | |
| 3,584,972 | 6/1971 | Bratkovich et al. . | |
| 3,606,573 | 9/1971 | Emmerson et al. | 416/231 R |
| 3,620,643 | 11/1971 | Jones | 416/231 R |
| 3,698,834 | 10/1972 | Meginnis | 416/231 R |
| 4,004,056 | 1/1977 | Carroll | 60/754 |

*Primary Examiner*—Robert E. Garrett
*Attorney, Agent, or Firm*—J. C. Evans

[57] ABSTRACT

A gas turbine engine combustor has a porous wall structure for directing coolant from a compressed air plenum into a combustion chamber to cool its inner surface; an outer lamina has a first hole pattern therein and an inner lamina diffusion bonded to the outer lamina has a second hole pattern offset from the first hole pattern to direct air from the air plenum in cross-flow relationship across internal walls to cool the outer and inner lamina and the outer lamina has a plurality of relief notches formed part way through its depth which are responsive to thermal gradients across the porous wall structure to break the outer lamina into a plurality of separated shingles thereby to prevent excessive stress formation in the porous wall structure; the inner lamina including flow control means to maintain a regulated flow of coolant from an inlet air plenum to the combustion chamber irrespective of the number of relief notches broken during operation of the gas turbine engine.

3 Claims, 5 Drawing Figures

SHINGLED LAMINATED POROUS MATERIAL

This invention relates to improvements in porous laminated material for gas turbine engine combustors and other such devices which are protected from high temperature gas by discharge of a cooling gas through numerous pores distributed over the surface of the combustors or a like high temperature operating device and more particularly to such laminated material having structure therein to relieve stresses due to differential thermal expansion between lamina of the laminated material.

This invention is particularly adapted to transpiration cooled combustors with laminated porous metal walls of the general sort described in prior patent applications, of common ownership with this application, as follows. U.S. Pat. No. 3,584,972, issued June 15, 1971, to Bratkovich and Meginnis, for "Laminated Porous Metal;" U.S. Pat. No. 4,191,011, issued Mar. 4, 1980, by Sweeney and Verdouw, for "Gas Turbine Engine Combustor Mounting," and U.S. Pat. No. 4,244,178, issued Jan. 13, 1981, by Herman and Reider, for "Porous Laminated Combustor Structure:" These turbine engine combustors have laminated walls, the layers of which have grooves and/or holes which are formed in the surface of the layer by a process such as photoetching to provide flow passages and numerous inlets and outlets for cooling air or other gas between the exterior and interior of the combustor. Combustors or other structures with porous laminated walls to be protected from hot gas by transpiration cooling will be referred to hereafter in this specification as "combustors."

Combustor apparatus for gas turbine engines typically includes a plurality of generally axially directed pierced or louvered sleeve segments comprising air distribution systems to provide wall cooling of the liner segments of a combustor apparatus to prevent excessive flame erosion of the inside surface of combustor walls. Examples of such systems are set forth in U.S. Pat. Nos. 3,064,424, issued Nov. 20, 1962, to Tomlinson; U.S. Pat. No. 3,064,425, issued Nov. 20, 1962, to C. F. Hayes; and U.S. Pat. No. 3,075,352, issued Jan. 29, 1963, to L. W. Shutts.

While the aforesaid gas turbine engine combustors are suitable for their intended purpose, it is desirable to minimize flow of coolant air required to cool the inner wall of the combustion apparatus against flame erosion. Various proposals have been suggested to make the full wall of the combustor apparatus of porous material to cool the internal wall surface of the combustor apparatus by transpiration cooling as set forth in ASME Paper No. 79-GT-100, "Evaluation of Laminated Porous Wall Materials for Combustor Liner Cooling," D. A. Nealey and S. B. Reider, Mar. 15, 1979.

Combustor apparatus of the type including porous laminated walls with multiple layers of material, diffusion bonded together and including pores in the inner and outer layers interconnected by intermediate groove patterns between the laminated layers of the wall can have substantial thermal gradients from the outside to the inside of the combustor in part because of the active cooling within the wall and in part because of relatively large heat transfer rates into the structure. Such thermal gradients can result in stresses which require relief.

Accordingly, an object of the present invention is to provide an improved porous laminated metal construction including at least two layers of material having inlet pores formed on one side thereof and outlet pores formed on the other side thereof and means to separate the layers into separated shingles of porous metal material to achieve a maximum bonded area and compressive strength of the laminated metal porous wall while reducing thermally induced stress in the material and wherein the separated shingles are produced by a relief notch pattern formed in at least one layer of the laminated wall formed so that the permeability of the wall between the inlet and outlet pores will be maintained by controlled flow through the outlet pores.

Another object of the present invention is to provide an improved combustor apparatus for use in gas turbine engines including a tubular porous metal liner with pore-like perforations therethrough and relief grooves in layers of porous metal in the combustion apparatus liner which fracture to relieve thermal stresses in the liner during combustor operation.

Still another object of the present invention is to provide an improved gas turbine combustor assembly having a porous metal liner from the inlet to the outlet thereof and wherein the liner is a porous laminated wall with inlet pores across a porous metal layer receiving air from a compressed air plenum of a gas turbine engine and including an intermediate layer and with relief grooves in both layers which relieve to form shingles layers in the porous metal wall and including an inner lamina with pores to control plenum air flow into the combustor to cool the inner surface of the combustion liner.

Yet another object of the present invention is to provide an improved gas turbine engine combustor formed with a porous laminated metal sleeve continuously perforated between the inlet and outlet of the combustor and including wall laminates with spacer pins therein and wherein inlet pores through an outer wall layer communicate with intersecting, cross grooves in an intermediate wall layer to form a coolant flow path between the outer layer and an inner layer of the wall and wherein the outer and intermediate layers have relief grooves to prevent excessive thermally induced stress in the layers and wherein an inner layer has means therein to control coolant flow through the wall for effective cooling of the inner surface of the wall member when the outer and intermediate layers have stress relieved to form separated shingles therein.

Further objects and advantages of the present invention will be apparent from the following description, reference being had to the accompanying drawings wherein a preferred embodiment of the present invention is clearly shown.

Figure 1:
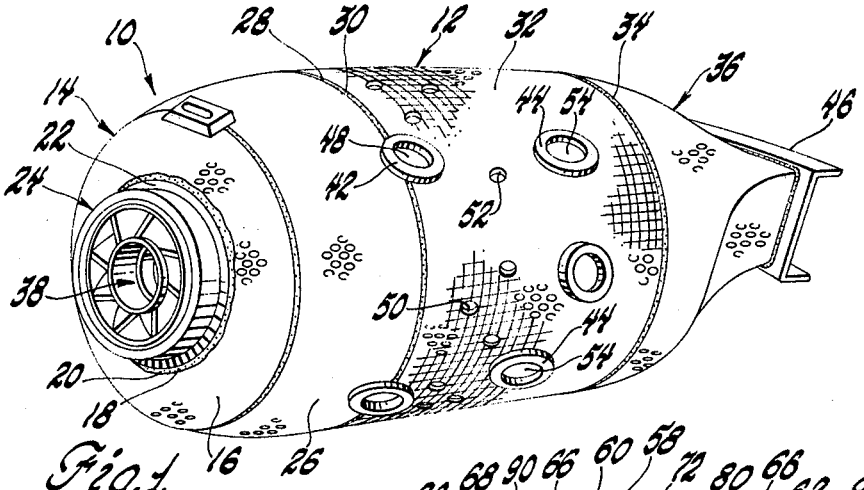
FIG. 1 is a view in perspective of a combustor apparatus including the present invention.
Figure 2:
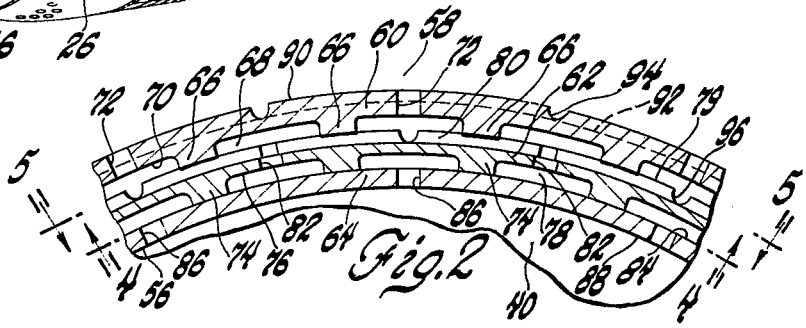
FIG. 2 is a sectional view taken along line 2—2 of FIG. 3.
Figure 3:
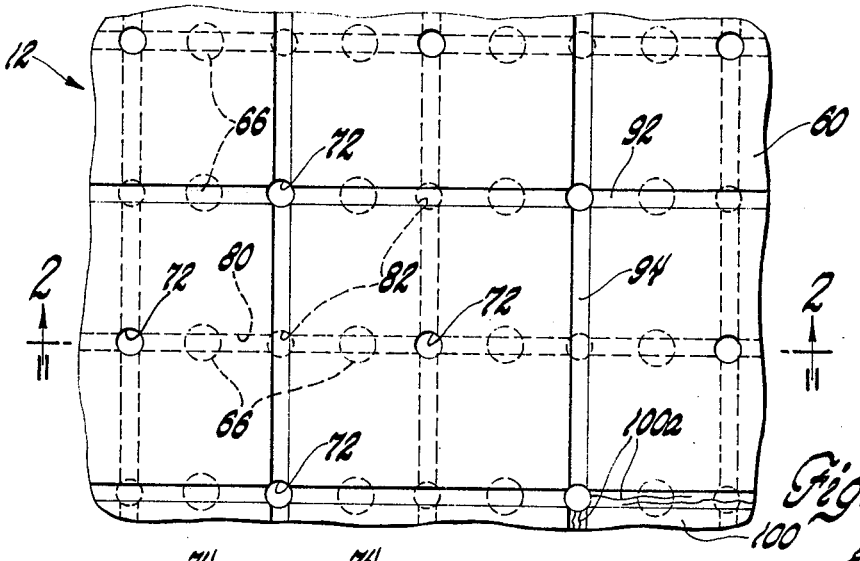
Figure 4:
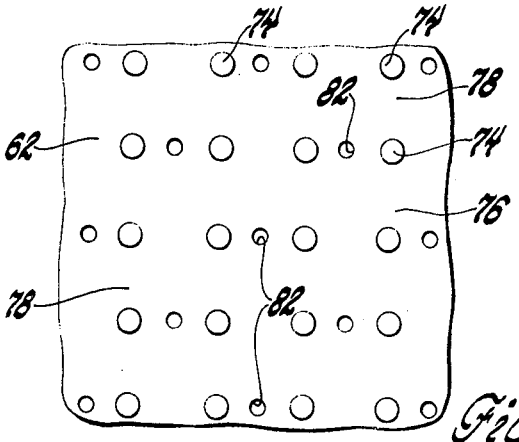
Figure 5:
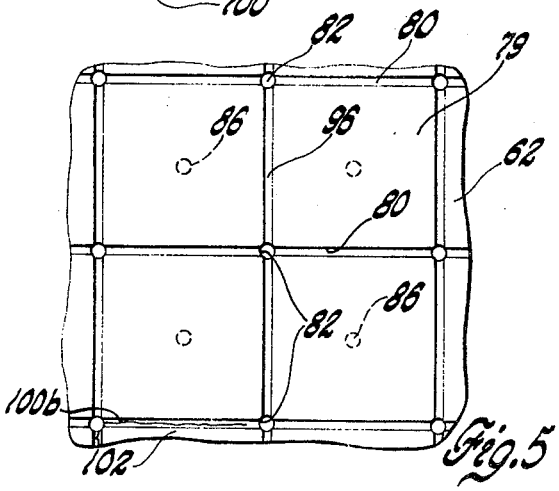

FIG. 3 is a fragmentary, enlarged elevational view of a portion of the outer surface of the apparatus in FIG. 1; and FIGS. 4 and 5 are sectional views taken along lines 4—4, and 5—5 of FIG. 2, respectively.

Referring now to the drawings, FIG. 1 shows a combustor assembly 10 including a porous laminated liner 12 constructed in accordance with the present invention.

Liner 12 has a dome 14 with a first contoured ring 16 of porous laminated material that includes a radially inwardly located edge portion 18 thereon secured by an annular weld 20 to a radially outwardly directed flange 22 of a support ring 24. A radially outwardly divergent contoured ring portion 26 of dome 14 also is made of porous laminated material. The contoured ring portion 26 has its downstream edge 28 connected by an annular weld 30 to a porous laminated sleeve 32 which is connected by means of an annular weld 34 to a flow transition member 36 of porous laminated material.

Ring 24 forms a housing for an air blast fuel nozzle assembly 38 that directs air and fuel into a combustion chamber 40 within the combustor assembly 10.

In accordance with the present invention, the liner 12 of the combustor assembly 10 is defined by the dome 14, contoured rings 16, 26 and sleeve 32 to produce a transpiration cooled wall construction that minimizes the requirement for wall cooling air while adequately cooling the inside surface of the combustor assembly 10 exposed to the flame front within the combustion chamber 40.

Each segment of porous laminated liner 12 as shown in FIGS. 2–5 is made up of a plurality of porous layers or lamina. Sleeves 42, 44 and 46 are mounted on the lamina. The pores have a diameter such that the liner 12 has a discharge coefficient of 0.006 per square inch of liner wall area. Air distribution into combustor assembly 10 includes 11.5% of total air flow via assembly 38. A front row of primary air holes 48 at sleeves 42 receive 14.5% of total air flow; a pair of rows or intermediate air holes 50, 52 receives 8% and 5.6%, respectively, of the total combustor air flow. Dilution air holes 54 at sleeves 44 receive 35.8% of the total combustor air flow. Sleeve 46 is at the outlet of transition member 36.

The remainder of the total combustor air flow is through the liner wall pores. The aforesaid figures are representative of flow distributions in combustors using the invention. Cooling of the inner surface 56 of liner 12 is in part due to transpiration cooling as produced by flow of compressed air from a duct space or inlet air plenum 58 surrounding combustor assembly 10 to a point radially inwardly of the liner 12 through a plurality of pores and grooves therein in accordance with the present invention.

In fabrication of combustor assemblies such as combustor assembly 10 disclosed above, it is desirable to have a specifically configured pattern of pores and grooves in the layered material making up the laminate to improve the strength of the wall section as well as to reduce manufacturing costs thereof.

In the illustrated embodiment of the invention, a three plate laminate includes the outer layer or lamina 60, an intermediate layer or lamina 62 and an inner layer or lamina 64. The lamina 60 includes a plurality of inwardly directed pins 66 to form grooves 68 across the inner surface 70 thereof. Pins 66 are bonded to lamina 62. At spaced points the outer lamina 60 has pores 72 etched therein which intersect the grooves 68 along the length thereof. The pores 72 define inlet openings from the duct 58 to direct cooling air therefrom to the grooves 68. The intermediate lamina 62 has pins 74 on its inner surface 76 to form grooves 78 thereacross. The outer surface 79 of lamina 62 has grooves 80 in communication with grooves 68. Holes 82 in lamina 62 intersect grooves 78 and 80 to direct coolant through lamina 62. The inner lamina 64 is bonded at its outer surface 84 to pins 74. It also includes a plurality of holes 86 therein that intersect inner surface 88 of the inner lamina 64 which bounds combustion chamber 40. Cooling air thence flows through a plurality of outlet holes 86 in the inner lamina 64 for flow of cooling air from the porous laminated liner 12 of the combustor assembly 10 to produce a transpiration cooling of the inner wall surface 88 of the combustor assembly 10.

The three lamina structure described above has substantial thermal gradients from the outer surface 90 of the outer lamina 60 to the inner surface 88 of the inner lamina 64 produced in part by the act of cooling of the wall section as coolant air is directed through the tortuous path defined from the outer holes or pores 72 thence through the grooves 68 laterally defined between the pin 66 and through the holes 82 in part formed through the groove 80 and the inner surface 76 of the intermediate lamina 62. The air flow then flows through the lateral grooves 80 formed between the pin 74 for discharge through the inlet holes 82 into the inner surface 88 of the porous laminated liner 12. Furthermore, the aforesaid thermal gradients are in part produced because of relatively large heat transfer rates into the structure from the combustion process within the combustion chamber 40. In accordance with certain principles of the present invention, the outer surface of the outer lamina 60 has a plurality of stress relief grooves 92 directed longitudinally thereof and an intersecting set of offset intersecting stress relief grooves 94 which form a rectangular pattern as shown in FIG. 3 across the outer surface of at least the porous laminated sleeve 32 of the porous laminated liner 12. If desired, like stress relief grooves can be formed across other component parts of the laminated liner 12 as required to relieve stresses produced therein because of heat transfer rates into the structure of the laminated liner 12.

As shown, each of the stress relief grooves 92, 94 are formed only part way through the depth of the outer lamina 60 so that under initial conditions there is a solid outer lamina 60 in the structure. Likewise, the intermediate lamina 62 has a plurality of longitudinally directed stress relief grooves 96 formed therein that intersect with a like plurality of intersecting relief grooves 98 to form a rectangular pattern across the outer surface of the intermediate lamina 62 as best shown in FIG. 5. Again, the stress relief grooves 96, 98 are only formed through part of the depth of the intermediate lamina 62 so that it also is a solid plate when initially fabricated.

When excessive thermal stresses are produced during engine operation in the outer and intermediate laminas 60, 62 the stress relief grooves therein will separate to form a plurality of separate shingles in the outer and inner lamina of the porous laminated liner 12. A fragmentary one of the separate shingles is shown at 100 at the lower right hand corner of the portion of the outer surface of the liner 12 shown in FIG. 3. A separate shingle 102 is also shown in the fragmentary view of the outer surface of the intermediate layer as shown in FIG. 5 at the lower left hand corner thereof. Each of the separate shingles is bonded to the outer surface of the adjacent inner lamina of the laminated liner 12 by the bond between the pins 66 and 74 with the outer surfaces 79 and 84, respectively. The total amount of air flow from the inlet air plenum 58 into the combustion chamber 40 remains constant notwithstanding the number of relief cracks that are formed within the grooves as at 100*a* and 100*b* in FIGS. 3 and 5, respectively, because the holes 86 in the inner lamina 64 are preselected and sized to serve as the flow control orifices for air flow from the inlet air plenum 58 to the combustion chamber 40 and this amount of desired transpiration air coolant flow is maintained irrespective of the amount of stress relief which occurs in the structure by crack formation in the stress relief grooves formed in the laminates of the structure.

While a three laminate structure is illustrated it is to be recognized that, in certain cases, a two laminate structure is equally suited for practising the present invention and in this case the stress relief grooves will be formed on the outer laminate as in the case of the outer lamina 60 and the inner lamina of the two laminate structure will have the flow controlling holes formed therein.

It has been observed that the two lamina configurations produce a greater flow than three lamina because, if the overall thickness of the laminated material remains the same, the two lamina construction is arranged so that each of the individual layers will have a slightly greater thickness than the thickness of the three lamina configuration. As a result, when pores are photoetched or otherwise machined in the two lamina construction they can have a slightly greater diameter than in the three lamina construction while maintaining desired strength characteristics.

To be more specific, regarding the scale of the parts to be bonded together, in the embodiments of FIGS. 1 through 5, the individual sheets have a thickness in the order of 0.030 inches and the hole spacing of the pores or holes is in the order of 0.136 inches. The pores and the grooves having the pattern set forth above are preferably obtained by photoetching processes wherein the individual layers of the sheet are etched or otherwise formed and are then united into a laminate by a suitable diffusion bonding process.

Representative types of high temperature alloys which are suitable for use in forming porous material having the configuration set forth in the illustrated embodiment are set forth in the tabulation below. Such materials are resistant to extremely high temperature operation in environment such as gas turbine engines.

| Name | AMS Spec. | Cr | Co | Mo | La | W | Al | Fe | Ni |
|---|---|---|---|---|---|---|---|---|---|
| Hastelloy X | 5536 | 22 | 1.5 | 9.0 | — | 0.6 | — | 18.5 | Base |
| Haynes 188 | 5608 | 22 | Base | — | .07 | 14.5 | — | — | 22 |
| Inconel 601 | 5870 | 23 | — | — | — | — | 1.35 | 14.0 | Base |
| Hastelloy S | 5873 | 15.8 | — | 12.5 | .05 | — | .3 | — | Base |

While the embodiment of the present invention, as herein disclosed, constitutes a preferred form, it is to be understood that other forms might be adopted.

The embodiments of the invention in which an exclusive property or privilege is claimed are defined as follows:

1. In a combustor assembly adapted for disposition in an air inlet plenum of a gas turbine engine and including a porous laminated wall structure having a first lamina and a second lamina with diffusion bond means therebetween for structural integrity, at least one of said first and said second lamina having coolant air distribution means therein in the form of relieved passage means of predetermined depth in said one lamina to permit coolant air flow between a plurality of pores in each of said first and said second lamina, said one lamina having minimum thickness at the deepest portion of said relieved passage means, the improvement comprising means on said one lamina defining a pattern of interconnecting stress relief grooves which cooperate with said relieved passage means in defining crack sections coextensive with said relief grooves and, having depth less than said minimum thickness so that thermal stress induced by a temperature gradient across said wall structure is concentrated at said crack sections to fracture said one lamina thereat into a plurality of separate shingles thereby preventing excessive stress formation in said wall structure.

2. The improvement recited in claim 1 further including flow control means on the other of said first and said second lamina operative to maintain regulated flow of coolant air across said wall structure regardless of the increase in porosity of said first lamina created by the fracture thereof into said plurality of shingles.

3. In a combustor assembly adapted for disposition in an air inlet plenum of a gas turbine engine and including a porous laminated wall structure having an inner lamina exposed to high temperatures in said combustor and an intermediate lamina and an outer lamina exposed to said inlet air plenum, said inner and said intermediate and said outer lamina being diffusion bonded together for structural integrity, first relieved passage means of predetermined depth in said outer lamina adjacent said intermediate lamina operative to permit coolant air flow from a plurality of pores in said outer lamina to a plurality of offset pores in said intermediate lamina with the minimum thickness of said outer lamina occurring at the deepest portion of said first relieved passage means, second relieved passage means of predetermined depth in said intermediate lamina adjacent said inner lamina operative to permit coolant air flow from said plurality of offset pores to a plurality of control pores in said inner lamina with the minimum thickness of said intermediate lamina occurring at the deepest portion of said second relieved passage means, in said combustor assembly the improvement comprising, means on said outer lamina defining a first pattern of interconnecting stress relief grooves which cooperate with said first relieved passage means in defining first crack sections coextensive with said first relief grooves and having depth less than said minimum thickness of said outer lamina, and means on said intermediate lamina defining a second pattern of interconnecting stress relief grooves corresponding in shape to said first pattern of stress relief grooves but offset therefrom, said second pattern of stress relief grooves cooperating with said second relieved passage means in defining second crack sections coextensive with said second relief grooves and having depth less than said minimum thickness of said intermediate lamina, each of said first and said second crack sections being operative to concentrate thermal stresses in corresponding ones of said outer and said intermediate lamina induced by a temperature gradient across said wall structure so that said outer and said intermediate lamina are fracturable at said crack sections into a plurality of separate shingles thereby preventing excessive stress formation in said wall structure, said control pores in said inner lamina being operative to regulate the flow of coolant air across said wall structure regardless of the increase in porosity of said outer and said intermediate lamina created by the fracture thereof into said plurality of shingles.

* * * * *